United States Patent [19]

Dearnaley et al.

[11] Patent Number: 4,465,524

[45] Date of Patent: Aug. 14, 1984

[54] TITANIUM AND ITS ALLOYS

[75] Inventors: Geoffrey Dearnaley, Abingdon; Robert E. J. Watkins, Brightwell-cum-Sotwell, both of England

[73] Assignee: United Kingdom Atomic Energy Authority, London, England

[21] Appl. No.: 415,456

[22] Filed: Sep. 7, 1982

Related U.S. Application Data

[62] Division of Ser. No. 214,102, Dec. 8, 1980, Pat. No. 4,364,969.

[30] Foreign Application Priority Data

Dec. 13, 1979 [GB] United Kingdom ..... 7943049

[51] Int. Cl.[3] ..... C23C 13/02

[52] U.S. Cl. ..... 148/31.5; 75/65 EB; 148/4; 148/421; 428/660

[58] Field of Search ..... 148/31.5, 421, 4; 428/660; 75/65 EB; 427/38, 42, 383.9

[56] References Cited

U.S. PATENT DOCUMENTS

| | | | |
|---|---|---|---|
| 3,341,352 | 9/1967 | Ehlers | 427/38 |
| 3,718,502 | 2/1973 | Gibbons | 427/38 |
| 3,988,955 | 11/1976 | Engel | 148/31.5 |
| 4,137,370 | 1/1979 | Fujishiro | 427/38 |
| 4,364,969 | 12/1982 | Gaerttner | 427/38 |

*Primary Examiner*—Peter D. Rosenberg
*Attorney, Agent, or Firm*—William R. Hinds

[57] ABSTRACT

Bodies made of titanium or its alloys, having surfaces liable to wear, have their wear resistance improved by coating such surfaces with a layer of a metal such as tin or aluminum which has been bombarded with ions of a light species such as nitrogen, carbon, boron, or neon so as to cause the metal to migrate into the titanium or titanium alloy. The modified surface has improved wear resistance and reduced coefficient of friction.

10 Claims, 1 Drawing Figure

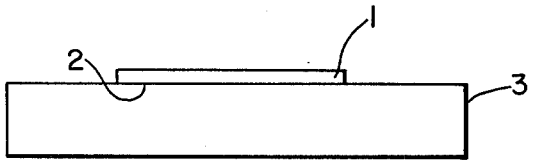
1
2
3
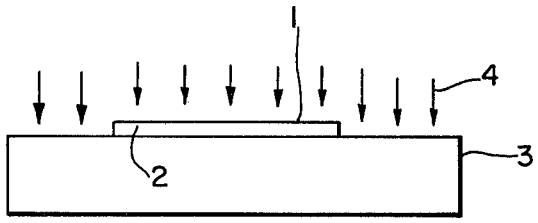
1
4
2
3
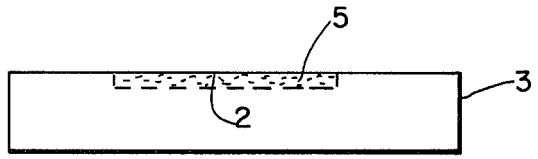
5
3
2

TITANIUM AND ITS ALLOYS

This is a division of application Ser. No. 214,102 filed Dec. 8, 1980 now U.S. Pat. No. 4,364,969.

The invention relates to the improvement of the wear resistance of titanium and its alloys.

Titanium and its alloys possess excellent properties as regards lightness and strength, but they are prone to adhesive wear and galling. In attempts to overcome these problems, surface coatings of one form or another frequently are applied. However, these coatings often introduce further problems in that they may be brittle and have poor adhesion to the coated body.

According to the present invention, there is provided a workpiece of titanium or an alloy of titanium having a surface treated to improve its wear resistance, the surface having been treated by a process generally comprising the operations of coating a surface of a workpiece made of titanium or an alloy of titanium and which is likely to be subject to wear with a layer of a selected metal and then subjecting the coated surface to bombardment with ions of a light species, so as to cause the metal to migrate into the workpiece.

Suitable metals are tin or aluminum. Other metals which may be usable are iron, copper, nickel, zinc, zirconium or platinum.

For the purposes of this specification, the term light refers to an ion species the mass of which is insufficient to cause a harmful degree of sputtering of the surface during implantation. The ion species can be inert or ions of a metallurgically active material. Preferred ion species are $N^+$, $B^+$, $C^+$, or $Ne^+$. The movement of the tin into the workpiece being treated is facilitated if the temperature of the workpiece is raised to at least 400° C., and preferably to about 600° C. This can be done either by carrying out the ion bombardment at a power level such that the temperature of the workpiece is caused to rise to the desired level, or by arranging for the workpiece to be heated.

BRIEF DESCRIPTION OF THE DRAWINGS

The invention will now be described, by way of example, with reference to the accompanying diagrammatic representation of the stages of preparation of an embodiment of the invention.

A layer 1 of tin about 400 A was deposited by electron beam evaporation in a vacuum on a region 2 of a surface of a polished disc 3 of titanium alloy. This is a technique which is well-known in the semi conductor art and which it is thought unnecessary to describe. The titanium alloy contained 6% of aluminium and 4% of vanadium by weight. The disc 3 was then subjected to bombardment by a beam 4 of molecular nitrogen ions having an energy of 400 kev. The current density of the ion beam 4 was about 30 $\mu A/cm^2$ and the bombardment was continued until a dose of $4\times10^{17}N_2^+$ ions per $cm^2$ had been implanted. During the ion bombardment the temperature of the disc was allowed to rise to a temperature of about 600° C. The layer 1 of tin was found to be no longer on the surface of the disc 3 but formed a buried layer 5. Analysis of the layer 5 by means of a Rutherford back scattering technique showed that the tin had penetrated several thousand angstroms into the titanium; far further than one would expect if the implantation mechanism was due to recoil under the ion bomardment only.

The wear characteristics of the disc were then determined by means of a standard technique in which a loaded pin was brought to bear on the disc while it was rotated so that the pin bore on both treated and untreated parts of the disc. The pin was an untreated cylinder of the titanium alloy 1 mm in diameter, and loads of between 5 and 20N were applied. The relative velocity between the pin and the disc was 6.8 cm/sec. White spirit (a mixture of 61% wt paraffins, 20% wt napthenes and 19% wt aromatics) was used, both to provide cooling and to flush away wear debris.

The untreated area of the disc showed a wear characteristic which was typical of that of titanium, that is to say, that the rate of wear was high and increased with time, accompanied by severe galling. The volumetric wear parameter, K, during a test period of 1 hour at a load of 5N was found to be $1\times10^{-6}$ where K is defined by:

$$K = \frac{\text{volume removed}}{\text{apparent area of contact} \times \text{sliding distance}}$$

The treated area of the disc showed no measurable wear after each of the following tests:

(1) 5N load over a sliding distance of $3.8\times10^5$ cms (17 hrs).

(2) 10N load over a sliding distance of $3.8\times10^5$ cms (17 hrs).

(3) 20N load over a sliding distance of $1.2\times10^5$ cms (5.8 hrs).

(4) 30N load over a sliding distance of $4.0\times10^4$ cms (2 hrs).

The tests were all carried out with the same end of the same test pin, although on different parts of the disc. Although the total testing time after the third test was nearly 40 hours, microscopic examination of the end of the test pin showed that the original grinding marks were still visible with minute wear scars superimposed upon them running in the direction of the relative motion between the test pin and the disc.

After 2 hours at the load of 30N, breakdown of the layer 5 occurred. The subsequent wear parameter was the same as that usually observed for titanium on titanium.

Measurements showed that during test 1 the wear parameter K increased steadily from less than $2\times10^{-10}$ to about $7\times10^{-10}$ giving a final improvement factor of about $1.4\times10^3$ over the value of K for the untreated region of the disc. Also during test 1 it was found that the coefficient of friction of the treated area of the disc was only 47% of that of the untreated area of the disc, and that it showed much less variation with time than that of the untreated region of the disc. For all the tests the frictional forces were found to increase linearly with the load.

A subsequent examination of the treated area of the disc Mössbauer conversion electron microscopy showed that an intermetallic compound of the general formula $Ti_xSn_y$ had been formed in the layer 5.

We claim:

1. A workpiece of titanium or an alloy of titanium having a surface treated to improve its wear resistance, said surface having been treated by a process comprising the operations of coating the surface with a layer of a metal selected from the group consisting of aluminum, copper, iron, tin, nickel, platinum, zinc and zirconium, and then subjecting the coated surface to bombardment with ions of a species the mass of which is insufficient to cause a harmful degree of sputtering of the surface during implantation, so as to cause the metal to migrate into the workpiece, in which workpiece the metal layer is no longer on the original workpiece surface but has migrated into the workpiece to form a modified surface which has improved wear resistance and reduced coefficient of friction relative to the original surface or any untreated surface areas of the workpiece.

2. A workpiece according to claim 1 wherein the metal is tin or aluminum.

3. A workpiece according to claim 1 or claim 2 wherein the bombarding ion species is selected from the group comprising $N^+$, $B^+$, $C^+$ and $Ne^+$.

4. A workpiece according to claim 3 wherein the ion species is $N^+$.

5. A workpiece according to claim 1 wherein the bombardment with the ion species is continued until a dose of the order of $10^{17}$ ions per $cm^2$ has been implanted into the workpiece.

6. A workpiece according to claim 1 wherein the temperature of the workpiece is raised to at least 400° C. while it is being bombarded with the ion species.

7. A workpiece according to claim 6 wherein the temperature of the workpiece is raised to 600° C.

8. A workpiece according to claim 6 or claim 7 wherein the bombardment with the ion species is carried out at a power level such as to cause the temperature of the workpiece to rise to the specified level.

9. A workpiece according to claim 1 wherein the workpiece is bombarded with a beam of ions having an energy of 400 kev and a current density of 30 $\mu A$ per $cm^2$.

10. A workpiece according to claim 1 wherein the coating is by electron beam evaporation in a vacuum.

* * * * *